US009824831B2

(12) United States Patent
Liu et al.

(10) Patent No.: US 9,824,831 B2
(45) Date of Patent: Nov. 21, 2017

(54) DETACHABLE KEYSWITCH MECHANISM AND RELATED ELECTRONIC DEVICE

(71) Applicant: Wistron Corporation, New Taipei (TW)

(72) Inventors: Yu-Ju Liu, New Taipei (TW); Che-Wen Liu, New Taipei (TW)

(73) Assignee: Wistron Corporation, New Taipei (TW)

( * ) Notice: Subject to any disclaimer, the term of this patent is extended or adjusted under 35 U.S.C. 154(b) by 137 days.

(21) Appl. No.: 14/465,825

(22) Filed: Aug. 21, 2014

(65) Prior Publication Data

US 2015/0294808 A1 Oct. 15, 2015

(30) Foreign Application Priority Data

Apr. 15, 2014 (TW) ..... 103113753 A

(51) Int. Cl.
*H01H 13/70* (2006.01)
*H01H 3/12* (2006.01)
*H01H 13/705* (2006.01)

(52) U.S. Cl.
CPC ..... *H01H 3/12* (2013.01); *H01H 3/122* (2013.01); *H01H 13/705* (2013.01);
(Continued)

(58) Field of Classification Search
CPC ..... H01H 3/12
(Continued)

(56) References Cited

U.S. PATENT DOCUMENTS 8,330,064 B2 * 12/2012 Ouyang ..... H01H 21/22 200/341
8,426,756 B2 * 4/2013 Yang ..... H01H 21/24 200/296

(Continued)

FOREIGN PATENT DOCUMENTS

CN 2638219 Y 9/2004
CN 103137364 A 6/2013

(Continued)

OTHER PUBLICATIONS

Office action dated May 13, 2015 for the Taiwan application No. 103113753, filing date: Apr. 15, 2014 p. 1 line 11~14, p. 2~7 and p. 8 line 1~16.

(Continued)

*Primary Examiner* — Renee S Luebke
*Assistant Examiner* — Lheiren Mae A Caroc
(74) *Attorney, Agent, or Firm* — Winston Hsu

(57) ABSTRACT

A detachable keyswitch mechanism includes a base and a keyswitch. The base includes a bottom plate and a lateral plate bent from the bottom plate. The base further includes an opening structure disposed on the lateral plate, a first rotating portion disposed between the bottom plate and the lateral plate, and a constraining portion disposed on the bottom plate. The keyswitch includes a body rotatably disposed inside the opening structure, a second rotating portion disposed on an upper side of the body and pivotably connected to the first rotating portion, a recovering portion connected to a low side of the body, and an actuating portion disposed on a surface of the body. An end of the recovering portion opposite to the body contacts against the constraining portion. The actuating portion is adapted to actuate a switch disposed on the base when the keyswitch rotates relative to the base.

16 Claims, 12 Drawing Sheets

(52) U.S. Cl.
CPC . *H01H 2221/016* (2013.01); *H01H 2221/044* (2013.01); *H01H 2221/05* (2013.01); *H01H 2225/028* (2013.01)

(58) Field of Classification Search
USPC ..... 200/341, 344, 345, 343
See application file for complete search history.

(56) References Cited

U.S. PATENT DOCUMENTS

| | | | | |
|---|---|---|---|---|
| 8,432,356 | B2 | 4/2013 | Chase | |
| 8,890,012 | B2 * | 11/2014 | An | H01H 13/04 200/293 |
| 2013/0033802 | A1 * | 2/2013 | Li | H04M 1/23 361/679.01 |

FOREIGN PATENT DOCUMENTS

| | | |
|---|---|---|
| TW | M377613 | 4/2010 |
| TW | 201133529 | 10/2011 |
| TW | M436219 | 8/2012 |
| TW | 201243895 | 11/2012 |

OTHER PUBLICATIONS

Office action dated Nov. 1, 2016 for CN application No. 201410180781.7, p. 3 line 4~45, pp. 4~5 and p. 6 line 1~6.

* cited by examiner

DETACHABLE KEYSWITCH MECHANISM AND RELATED ELECTRONIC DEVICE

BACKGROUND OF THE INVENTION

1. Field of the Invention

The present disclosure relates to a keyswitch and a related electronic device, and more particularly, to a lateral-typed keyswitch and a related electronic device with advantages of easy assembly, low cost and rework function.

2. Description of the Prior Art

A lateral keyswitch is often utilized to be the power button and/or the volume button of the electronic device. A first-type conventional keyswitch mechanism disposes the lateral keyswitch on a thin resilient component, and the thin resilient component is assembled with a casing of the electronic device by an engagement. The engagement has low constraint, and the lateral keyswitch is easily separated from the casing in transportation. A second-type conventional keyswitch mechanism fixes the lateral keyswitch on the resilient piece. An end of the resilient piece is locked on the lateral keyswitch, and the other end of the resilient piece is disposed on the casing by a thermal melt method, which has drawbacks of complicated procedure and expensive cost. A third-type conventional keyswitch mechanism integrates the lateral keyswitch with the resilient arm monolithically, and the resilient arm is thermally melted on the casing. Integrated assembly of the lateral keyswitch and the resilient arm cannot provide rework function. The casing may be scraped since the lateral keyswitch is damaged.

Please refer to FIG. 10 to FIG. 12. FIG. 10 to FIG. 12 respectively are diagrams of a keyswitch in prior art. As shown in FIG. 10, the lateral keyswitch 70 is disposed on the thin resilient component 72, and the thin resilient component 72 is installed on the casing 76 by the engaging portion 74. However, the thin resilient component 72 is easily separated from the casing 76 in transportation, and an extra inspection cost of the product is consumed. As shown in FIG. 11, the keyswitch 78 is disposed on the curved resilient piece 80, and the curved resilient piece 80 is disposed on the casing 82 by the thermal melt method to prevent the curved resilient piece 80 and the casing 82 from separation. The curved resilient piece 80 is usually made of metal material that has high material cost and expensive thermal melt cost. The thermal melt method has no rework function. As shown in FIG. 12, the keyswitch 84 is integrated with the resilient arm 86 monolithically. An end of the resilient arm 86 is connected to the keyswitch 84, and the other end of the resilient arm 86 is thermally melted on the casing 88. The resilient arm 86 is made of plastic material, which is cheaper than the metal material. The resilient arm 86 is thermally melted on the casing 88 and cannot provide rework function.

SUMMARY OF THE INVENTION

The present disclosure provides a lateral-typed keyswitch and a related electronic device with advantages of easy assembly, low cost and rework function for solving above drawbacks.

According to the claimed disclosure, a detachable keyswitch mechanism with detachable function is disclosed. The detachable keyswitch mechanism includes a base and a keyswitch. The base has a bottom plate and a lateral plate, the lateral plate is bent from the bottom plate. The base further includes an opening structure, at least one first rotating portion and a constraining portion. The opening structure is disposed on the lateral plate. The first rotating portion is disposed between the bottom plate and the lateral plate. The constraining portion is disposed on the bottom plate. The keyswitch is detachably assembled with the base. The keyswitch includes a body, at least one second rotating portion, at least one recovering portion and an actuating portion. The body is rotatably disposed inside the opening structure. The body includes a first side and a second side opposite to each other. The second rotating portion is disposed on the first side and pivots to the first rotating portion. The recovering portion includes a first end and a second end opposite to each other. The first end is connected to the second side of the body, and the second end contacts against the constraining portion. The actuating portion is disposed on a surface of the body to actuate a switch disposed on the base.

According to the claimed disclosure, the first rotating portion is an arc structure, the second rotating portion is a pillar structure stretching from the body, and the pillar structure is rotatably disposed inside the arc structure.

According to the claimed disclosure, the base further includes a positioning portion disposed on the bottom plate. The body contacts the positioning portion to constrain relative movement between the body and the opening structure.

According to the claimed disclosure, the positioning portion includes a slide slot. The actuating portion moves inside the slide slot to constrain movement of the body relative to the opening structure.

According to the claimed disclosure, the body is rotatably switched between a first position and a second position relative to the opening structure.

According to the claimed disclosure, the keyswitch further includes a pressing portion disposed on the other surface of the body opposite to the actuating portion. The pressing portion protrudes from the opening structure since the body is located on the first position, and the pressing portion is partially retracted into the opening structure since the body is located on the second position.

According to the claimed disclosure, the switch includes a first unit and a second unit. The first unit slides relative to the second unit to actuate the second unit. A slide direction of the first unit relative to the second unit is substantially parallel to a connective direction between the actuating portion and the pressing portion.

According to the claimed disclosure, the recovering portion is resiliently deformed by inverse pressure of the body and the constraining portion since the body moves to the second position.

According to the claimed disclosure, the base further includes a hook disposed on the bottom plate and located between the opening structure and the constraining portion. A first part of the hook is connected to the bottom plate. A second part of the hook is bent from an end of the first part opposite to the bottom plate, and the second part contacts against a top of the recovering portion.

According to the claimed disclosure, the first part and the constraining portion respectively contact against opposite lateral surfaces of the recovering portion.

According to the claimed disclosure, the recovering portion is a straight resilient arm or a curved resilient arm. The first end of the recovering portion is bent from the body or disposed on a stretching portion of the body.

According to the claimed disclosure, an electronic device includes a first casing, a second casing and a detachable keyswitch mechanism. The second casing is assembled with the first casing. The detachable keyswitch mechanism is detachably disposed between the first casing and the second casing. The detachable keyswitch mechanism includes a base and a keyswitch. The base has a bottom plate and a lateral plate, the lateral plate is bent from the bottom plate. The base further includes an opening structure, at least one first rotating portion and a constraining portion. The opening structure is disposed on the lateral plate. The first rotating portion is disposed between the bottom plate and the lateral plate. The constraining portion is disposed on the bottom plate. The keyswitch is detachably assembled with the base. The keyswitch includes a body, at least one second rotating portion, at least one recovering portion and an actuating portion. The body is rotatably disposed inside the opening structure. The body includes a first side and a second side opposite to each other. The second rotating portion is disposed on the first side and pivots to the first rotating portion. The recovering portion includes a first end and a second end opposite to each other. The first end is connected to the second side of the body, and the second end contacts against the constraining portion. The actuating portion is disposed on a surface of the body to actuate a switch disposed on the base.

The present disclosure provides the detachable keyswitch mechanism with detachable function and the related electronic device. The keyswitch with integrated assembly of the body and the recovering portion can decrease the working hours and has no thermal melting cost. Further, the keyswitch is assembled with the base by the constraining portion and the rotating portion to increase assembly yield of product, and to prevent the detachable keyswitch mechanism from damage or disengage during transportation of the electronic device. Comparing to the prior art, the present disclosure provides the detachable keyswitch mechanism with rework function and the related electronic device that have advantages of high assembly yield, low manufacturing cost and easy assembly.

These and other objectives of the present disclosure will no doubt become obvious to those of ordinary skill in the art after reading the following detailed description of the preferred embodiment that is illustrated in the various figures and drawings.

DETAILED DESCRIPTION

Figure 1:
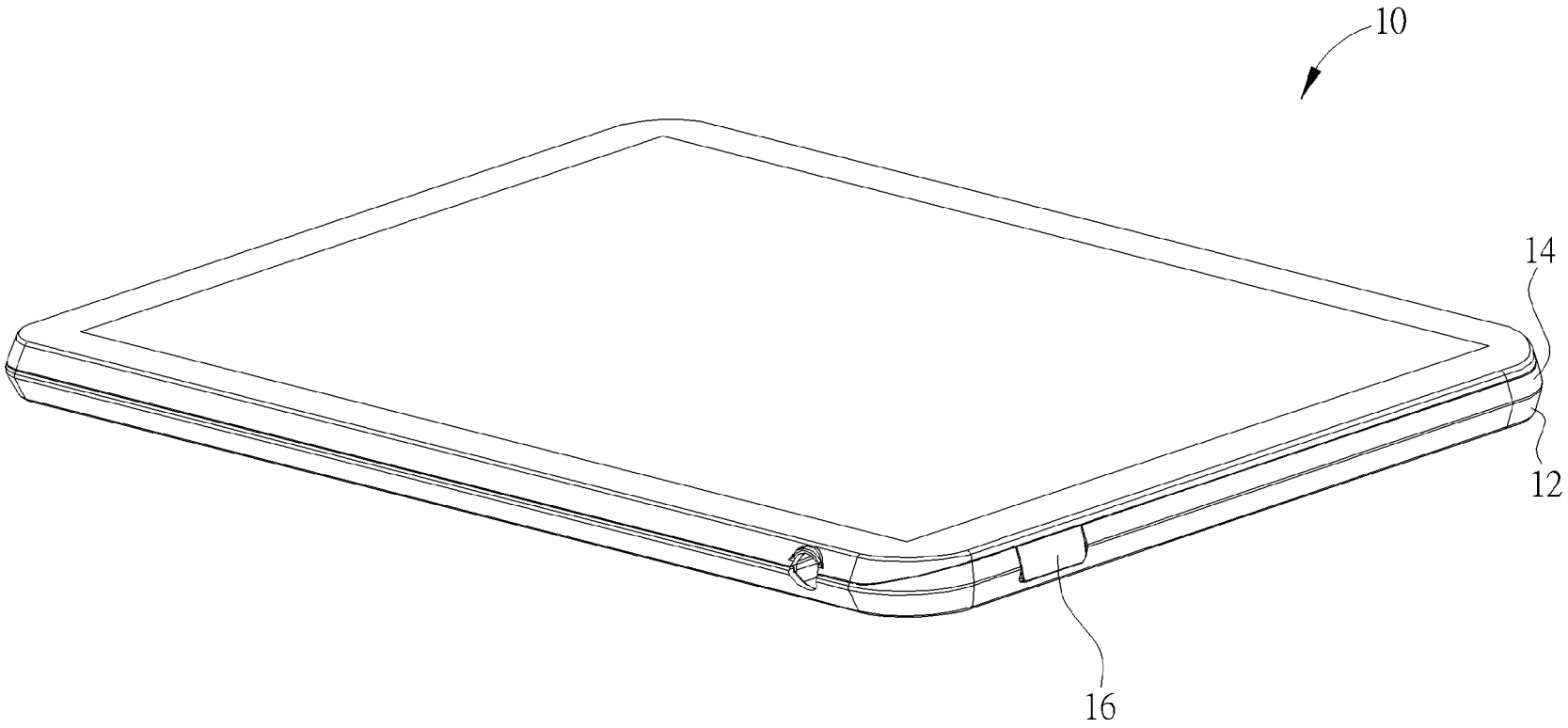
FIG. 1 is a diagram of an electronic device according to a first embodiment of the present disclosure.
Figure 2:
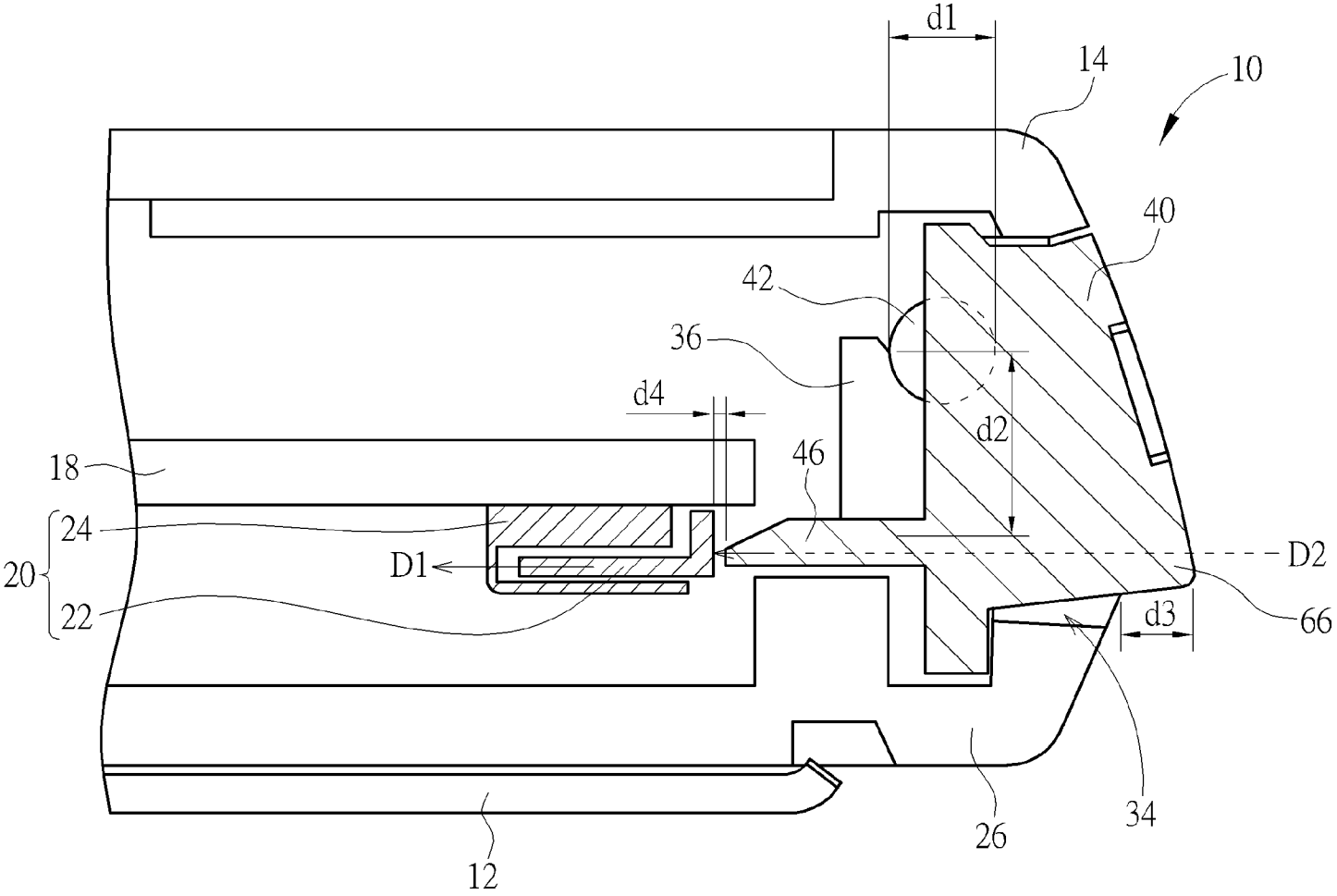
FIG. 2 is a sectional view of the electronic device according to the first embodiment of the present disclosure.

Please refer to FIG. 1 and FIG. 2. FIG. 1 is a diagram of an electronic device 10 according to a first embodiment of the present disclosure. FIG. 2 is a sectional view of the electronic device 10 according to the first embodiment of the present disclosure. The electronic device 10 includes a first casing 12, a second casing 14 and a detachable keyswitch mechanism 16. The electronic device 10 can be the tablet computer or the thin-typed notebook computer. The first casing 12 and the second casing 14 respectively are the front cover and the rear cover of the electronic device 10. The detachable keyswitch mechanism 16 is a lateral-typed keyswitch located on the lateral wall of the electronic device 10, and is disposed between the first casing 12 and the second casing 14. The detachable keyswitch mechanism 16 can be, but not limited to, the power button or the volume button of the electronic device 10.

A circuit board 18 is disposed inside the first casing 12. A switch 20 is disposed on an end of the circuit board 18 adjacent to the detachable keyswitch mechanism 16. The switch 20 includes a first unit 22 and a second unit 24, and the first unit 22 is slidably disposed on the second unit 24. The detachable keyswitch mechanism 16 moves the first unit 22 relative to the second unit 24, so as to trigger the second unit 24 and then to actuate the switch 20.

Figure 3:
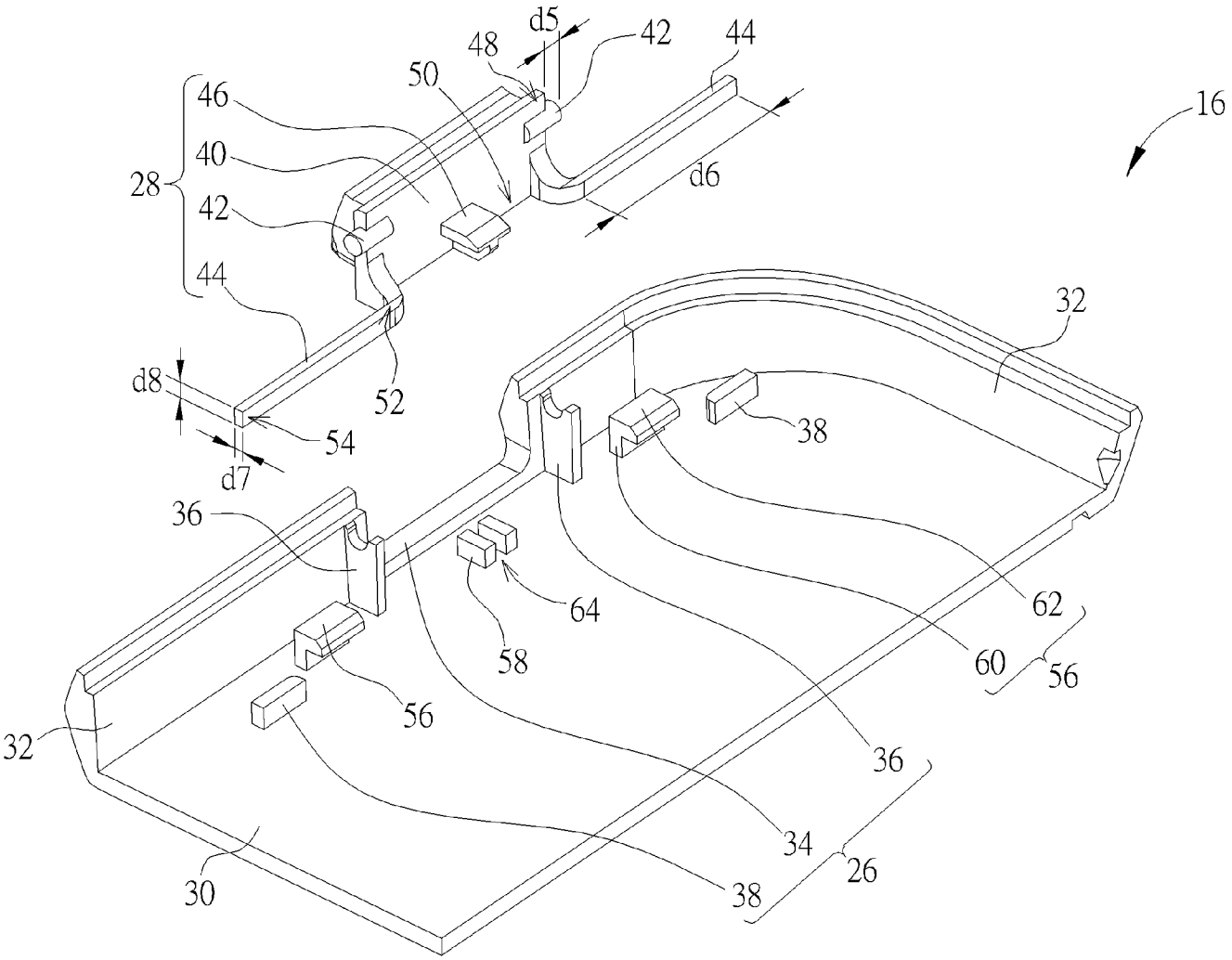
FIG. 3 is an explode diagram of a detachable keyswitch mechanism according to the first embodiment of the present disclosure.
Figure 4:
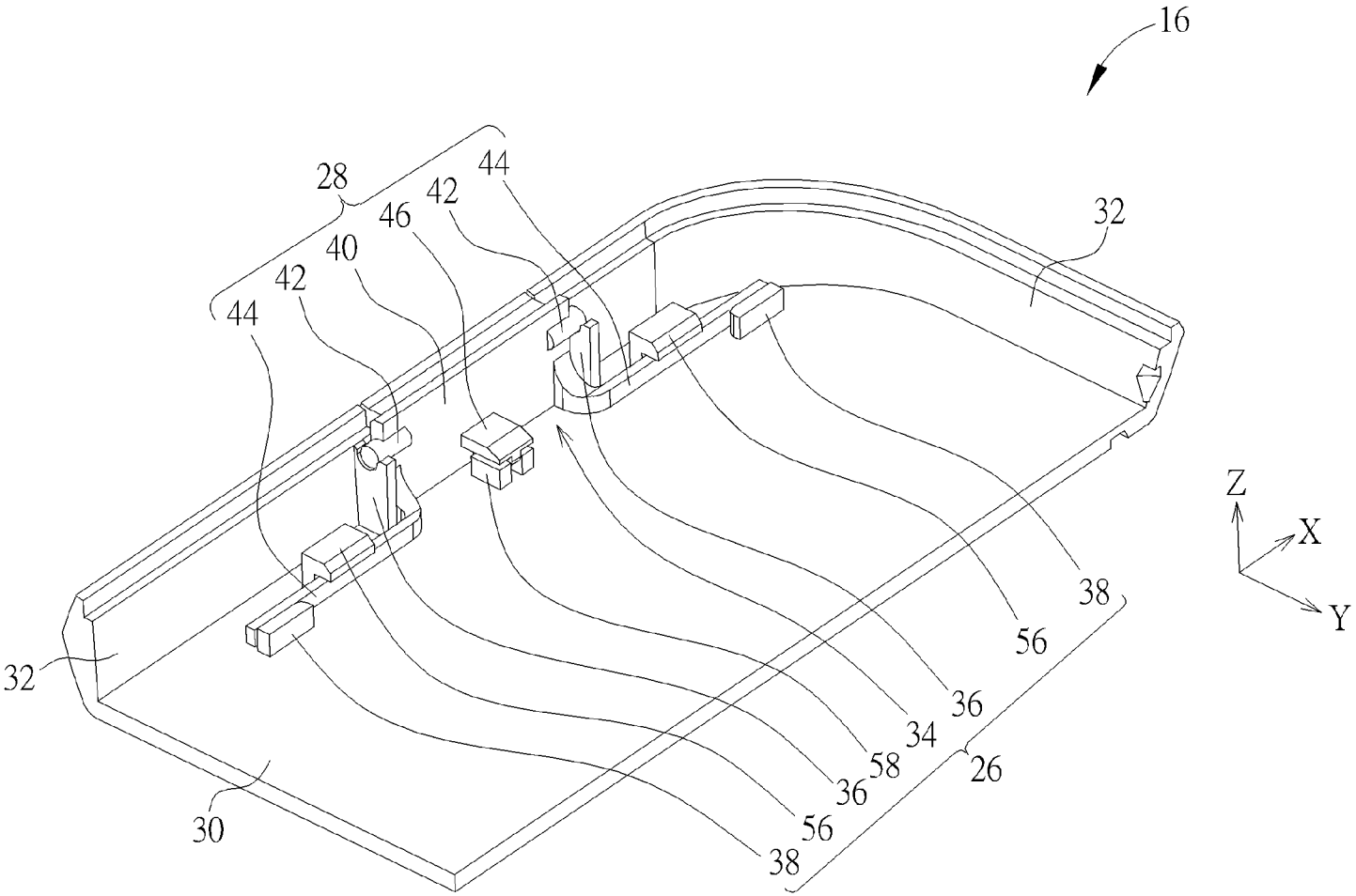
FIG. 4 is an assembly of the detachable keyswitch mechanism according to the first embodiment of the present disclosure.

Please refer to FIG. 2 to FIG. 4. FIG. 3 is an explode diagram of the detachable keyswitch mechanism 16 according to the first embodiment of the present disclosure. FIG. 4 is an assembly of the detachable keyswitch mechanism 16 according to the first embodiment of the present disclosure. The detachable keyswitch mechanism 16 includes a base 26 and a keyswitch 28. The keyswitch 28 is detachably assembled with the base 26 so that the detachable keyswitch mechanism 16 has rework function. The base 26 is located on the first casing 12, or the base 26 may be a part of the first casing 12. The base 26 has a bottom plate 30 and several lateral plates 32. The lateral plates 32 are bent from edges of the bottom plate 30 to form a supporter. For example, the circuit board 18 is disposed on the bottom plate 30 of the base 26. The base 26 includes an opening structure 32, a first rotating portion 36 and a constraining portion 38. The opening structure 34 is disposed on the lateral plate 32. The constraining portion 38 is disposed on the bottom plate 30. An amount of the first rotating portion 36 can be one or more. This embodiment preferably includes two first rotating portions 36 respectively disposed on opposite sides of the opening structure 34. The first rotating portion 36 is disposed on the bottom plate 30 adjacent to the lateral plate 32, such as being located between the bottom plate 30 and the lateral plate 32.

The keyswitch 28 includes a body 40, a second rotating portion 42, a recovering portion 44 and an actuating portion 46. The body 40 includes a first side 48 and a second side 50 opposite to each other. The second rotating portion 42 is disposed on the first side 48 (the upper side), and the recovering portion 44 is disposed on the second side 50 (the low side). An amount of the second rotating portion 42 corresponds to an amount of the first rotating portion 36, which means the keyswitch 28 includes at least one second rotating portion 42. This embodiment preferably includes two second rotating portion 42 respectively pivoting to the corresponding first rotating portion 36, and the body 40 can be rotatably disposed inside the opening structure 34. The second casing 14 further can be connected to the base 26 to enclose the opening structure 34 to prevent the body 40 and the opening structure 34 from separation. An amount of the recovering portion 44 equals at least one. This embodiment preferably includes two recovering portions 44 respectively disposed on opposite position of the body 40 to balance movement of the keyswitch 28 relative to the base 26. The recovering portion 44 includes a first end 52 and a second end 54 opposite to each other. The first end 52 is bent from the second side 50 of the body 40, and the second end 54 movably contacts against the constraining portion 38. Because the recovering portion 44 is made of resilient material, the recovering portion 44 can generate resilient deformation to store and to release resilient recovering force since the body 40 rotates relative to the opening structure 34 to switch its position. The actuating portion 46 is disposed on a lateral surface (an inner surface) of the body 40. When the keyswitch 28 is pressed, the body 40 pivots into the base 26 via a joint of the first rotating portion 36 and the second rotating portion 42, the actuating portion 46 slides the first unit 22 relative to the second unit 24 to actuate the switch 20.

In the first embodiment, the first rotating portion 36 can be an arc structure with sunken form, and the second rotating portion 42 can be a pillar structure stretching from the body 40. The second rotating portion 42 (the pillar structure) is put inside the first rotating portion 36 (the arc structure), so that the first rotating portion 36 is rotatably assembled with the second rotating portion 42, and the keyswitch 28 can be easily detached from the base 26. Structures of the first rotating portion 36 and the second rotating portion 42 are not limited to ones of the first embodiment, which depend on actual demand. For example, the first rotating portion 36 can be a protruding pillar structure, and the second rotating portion 42 can be a sunken arc structure.

The base 26 further can include a hook 56 and a position portion 58. The hook 56 is disposed on the bottom plate 30 and located between the opening structure 34 and the constraining portion 38. The hook 56 includes a first part 60 and a second part 62. An end of the first part 60 is connected to the bottom plate 30, the second part 62 is bent from the other end of the first part 60, and the hook 56 can be formed as a barb structure. When the keyswitch 28 is assembled with the base 26, the first rotating portion 36 pivots to the second rotating portion 42 (constraint of X-axis), the first part 60 and the constraining portion 38 respectively contact against opposite lateral surfaces of the recovering portion 44 (constraint of Y-axis), and the second part 62 contacts against a top of the recovering portion 44 (constraint of Z-axis). The keyswitch 28 can be protected without separation from the base 26 to effectively improve structural stability of the detachable keyswitch mechanism 16. The positioning portion 58 is disposed on the bottom plate 30. The positioning portion 58 is located on a position behind internal route of the keyswitch 28 in order to prevent the switch 20 from damage by overload of the keyswitch 28 (which means a rotary angle of the keyswitch 28 relative to the base 26 is greater than a threshold). Movement of the keyswitch 28 relative to the opening structure 34 is stopped since the body 40 of the keyswitch 28 contacts the positioning portion 58.

The positioning portion 58 can selectively include a slide slot 65, and a slot direction of the slide slot 64 is substantially parallel to a rotary direction of the keyswitch 28. The actuating portion 46 can move inside the slide slot 64 since the keyswitch 28 is pressed, so as to constrain the movement of the body 40 relative to the opening structure 34, and to ensure that the actuating portion 46 of the keyswitch 28 can accurately contact the switch 20.

Figure 5:
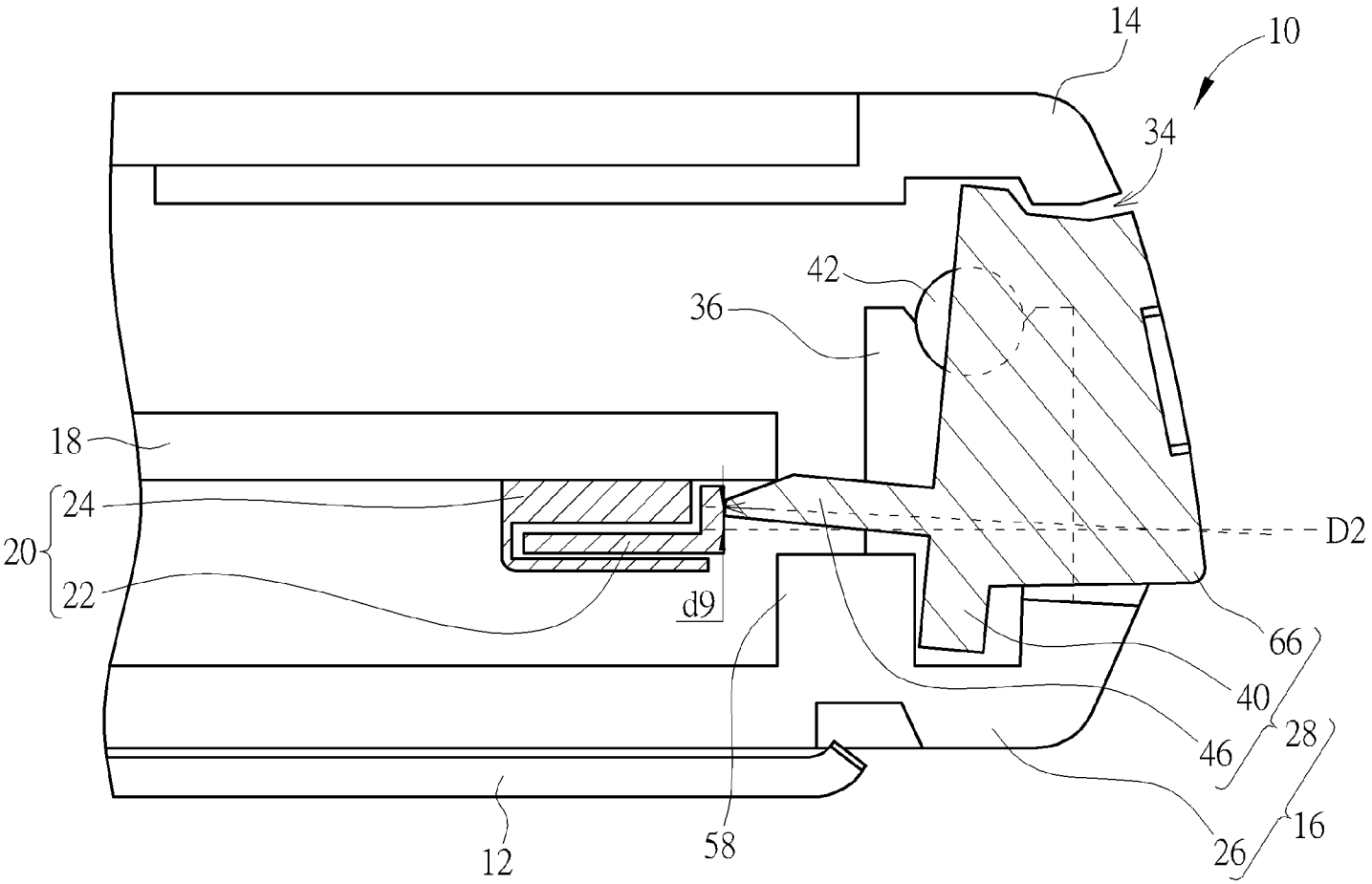
FIG. 5 is a sectional view of the electronic device in another operation mode according to the first embodiment of the present disclosure.

Please refer to FIG. 2 and FIG. 5. FIG. 5 is a sectional view of the electronic device 10 in another operation mode according to the first embodiment of the present disclosure. The body 40 of the keyswitch 28 can be rotatably switched between a first position (as shown in FIG. 2) and a second position (as shown in FIG. 5) relative to the opening structure 34 of the base 26. The keyswitch 28 further includes a pressing portion 66 disposed on another lateral surface (the outer surface) of the body 40 opposite to the actuating portion 46. As shown in FIG. 2, the body 40 is located on the first position, and the pressing portion 66 protrudes from the opening structure 34 for easy operation of the keyswitch 28. The switch 20 is preferably actuated by the keyswitch 28 in a straight motion manner, which means a slide direction D1 of the first unit 22 relative to the second unit 24 may be substantially parallel to a connective direction D2 between the pressing portion 66 and the actuating portion 46. During rotation of the keyswitch 28, the actuating portion 46 can accurately contact the switch 20, the actuating portion 46 does not miss the switch 20 by oblique motion and does not insert into an interval between the circuit board 18 and the first casing 12.

As shown in FIG. 5, the body 40 is located on the second position, and the pressing portion 66 is partially retracted into the opening structure 34 to slide the first unit 22 relative to the second unit 24 to actuate the second unit 24. Tolerance may be generated in assembly of the circuit board 18, the switch 20, the base 26 and the keyswitch 28. Design of the keyswitch 28 utilizing pivot of the rotating portions 36, 42 to actuate the switch 20 in a non-straight motion manner not only can economize inner allocation space of the second casing 14, but also can accurately actuate the switch 20 with elimination of the foresaid tolerance. Please refer to FIG. 4, the body 40 and the constraining portion 38 are located on opposite lateral surfaces of the recovering portion 44. The recovering portion 44 is resiliently deformed by inverse pressure of the body 40 and the constraining portion 38 since the keyswitch 28 is pressed to be retracted into the opening structure 34. As an external force applied to the keyswitch 28 is removed, resilient recovering force of the recovering portion 44 moves the keyswitch 28 from the second position shown in FIG. 5 to the first position shown in FIG. 2.

Figure 6:
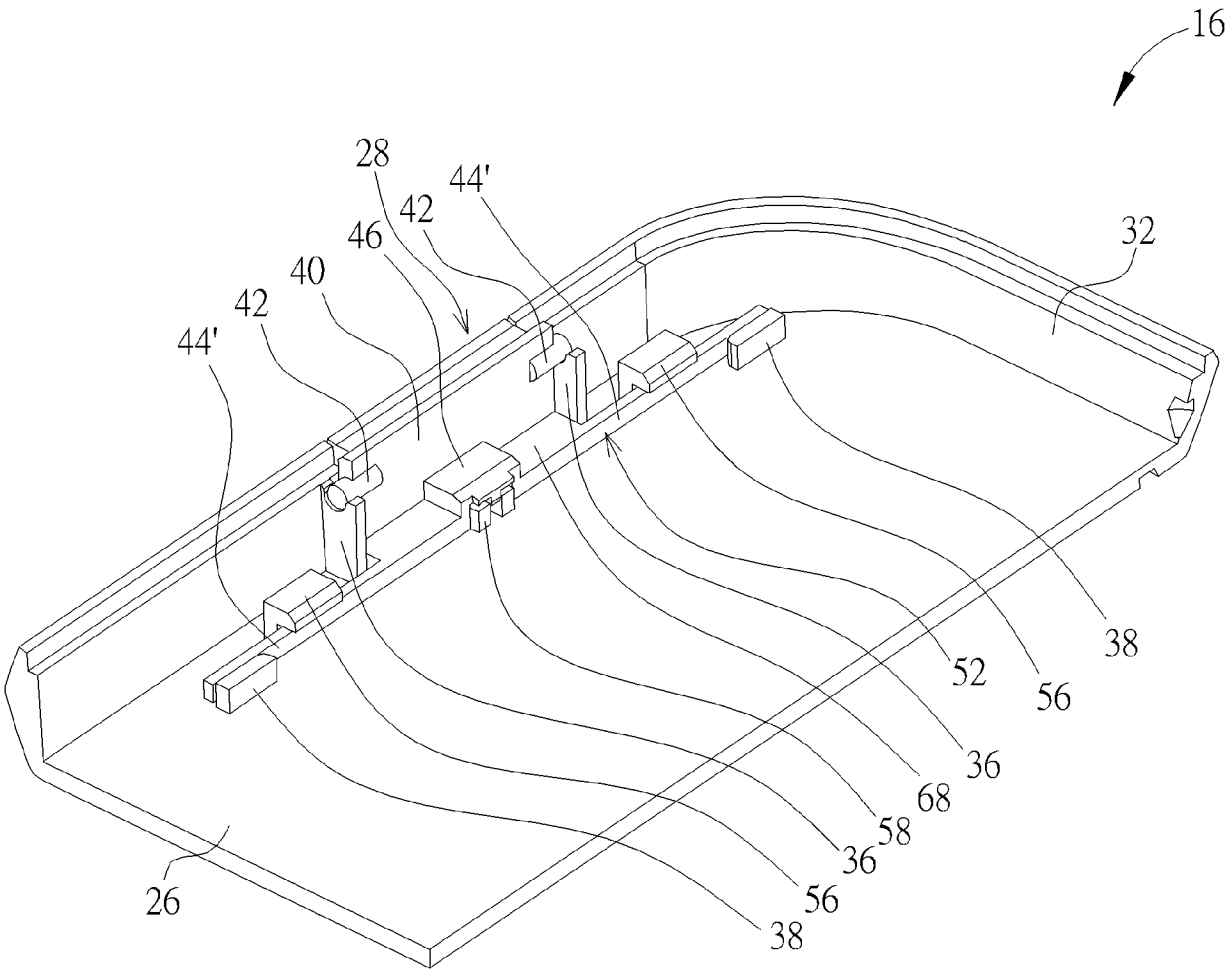
FIG. 6 is an assembly diagram of the detachable keyswitch mechanism according to a second embodiment of the present disclosure.
Figure 7:
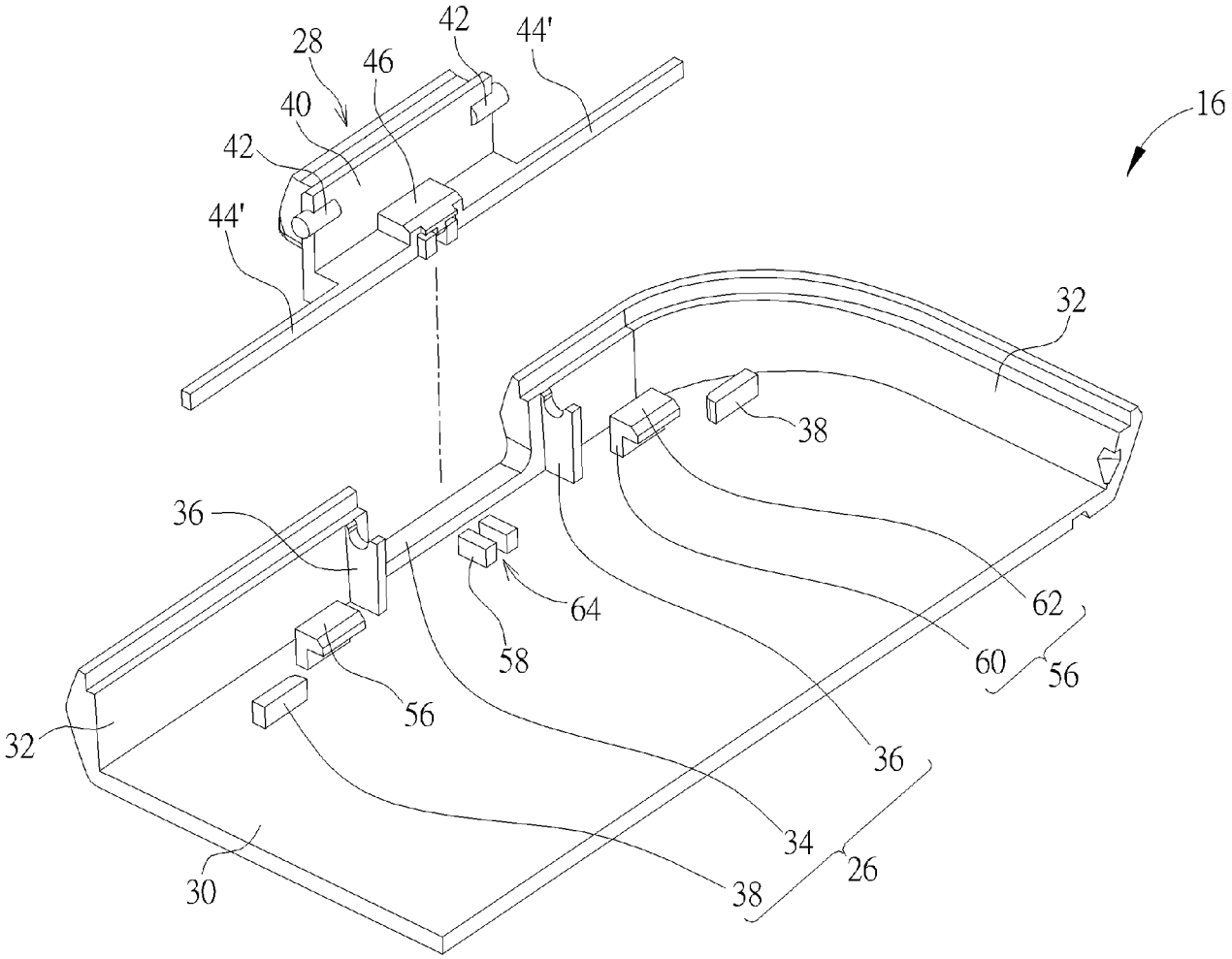
FIG. 7 is an exploded diagram of the detachable keyswitch mechanism according to the second embodiment of the present disclosure.

Please refer to FIG. 6 and FIG. 7. FIG. 6 is an assembly diagram of the detachable keyswitch mechanism 16 according to a second embodiment of the present disclosure. FIG. 7 is an exploded diagram of the detachable keyswitch mechanism 16 according to the second embodiment of the present disclosure. In the second embodiment, elements having the same numeral as ones of the first embodiment have the same structures and functions. Difference between the second embodiment and the first embodiment is: the recovering portion 44' of the keyswitch 28 is a straight resilient arm. An end (such as the first end 52) of the straight resilient arm is disposed on a stretching portion 68 of the body 40. The stretching portion 68 can completely cover or partly cover the positioning portion 58 to increase structural strength of the keyswitch 28, and rotation of the keyswitch 28 relative to the base 26 at a predetermined direction can be effectively constrained.

Figure 8:
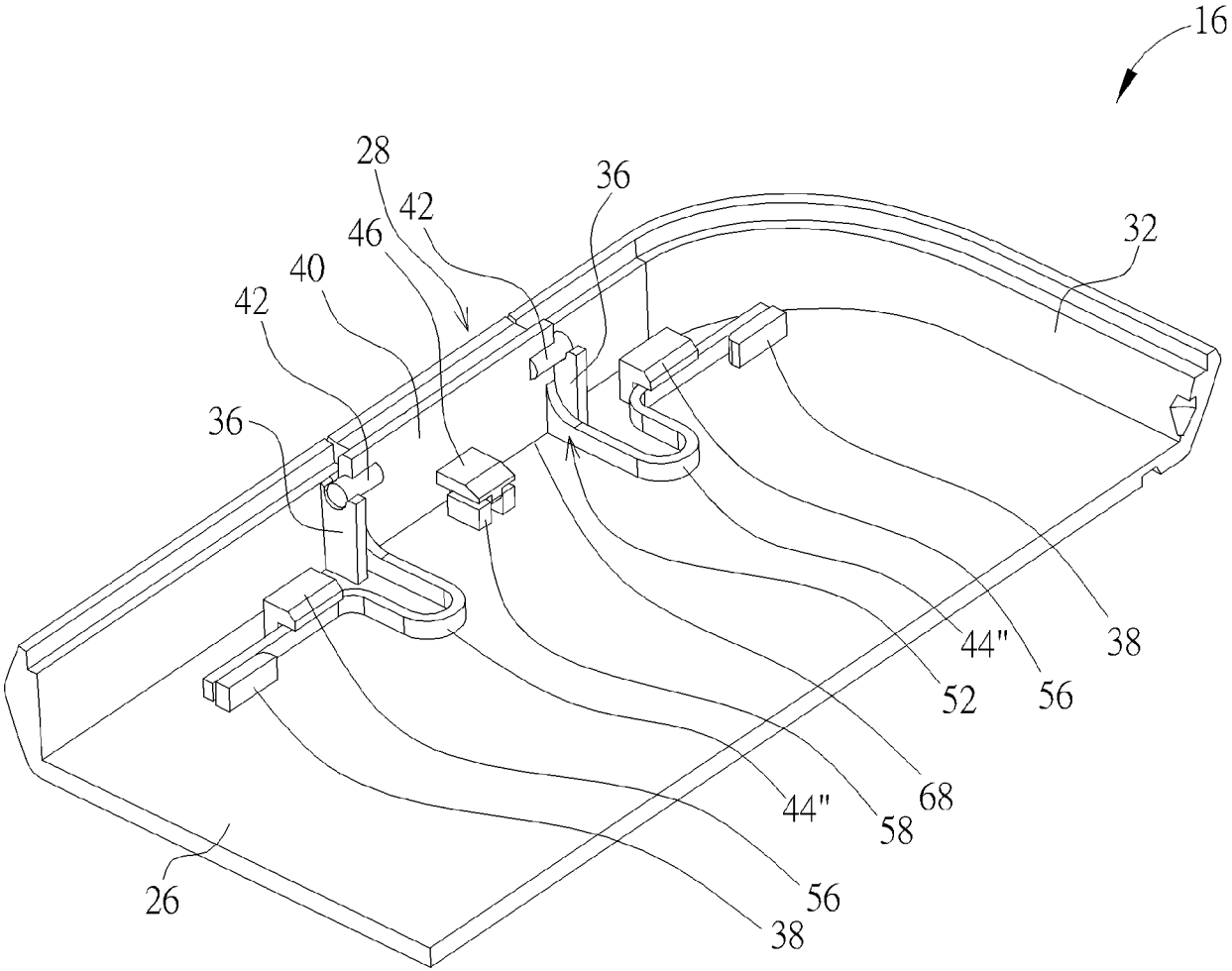
FIG. 8 is an assembly diagram of the detachable keyswitch mechanism according to a third embodiment of the present disclosure.
Figure 9:
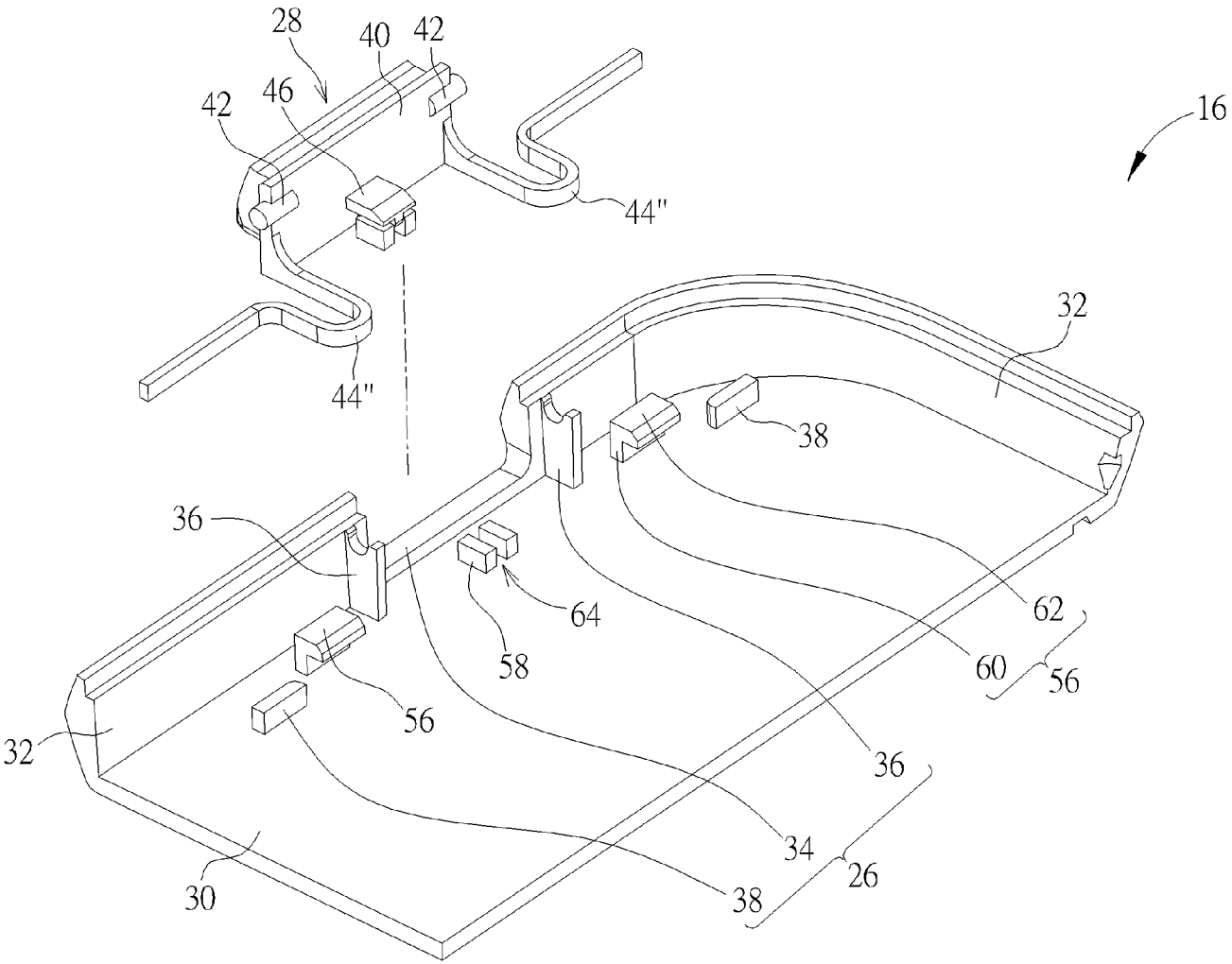
FIG. 9 is an exploded diagram of the detachable keyswitch mechanism according to the third embodiment of the present disclosure.
Figure 10:
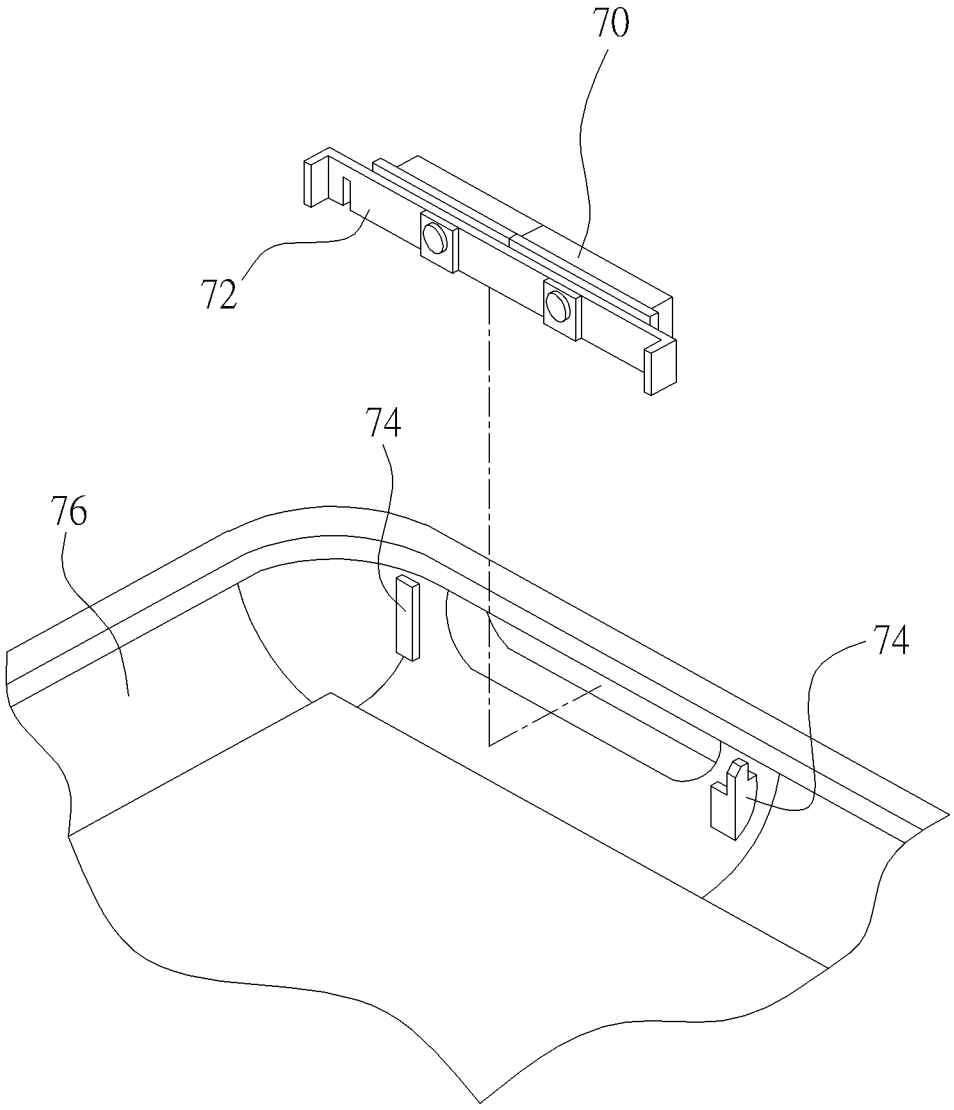
FIG. 10 to FIG. 12 respectively are diagrams of a keyswitch in prior art.
Figure 11:
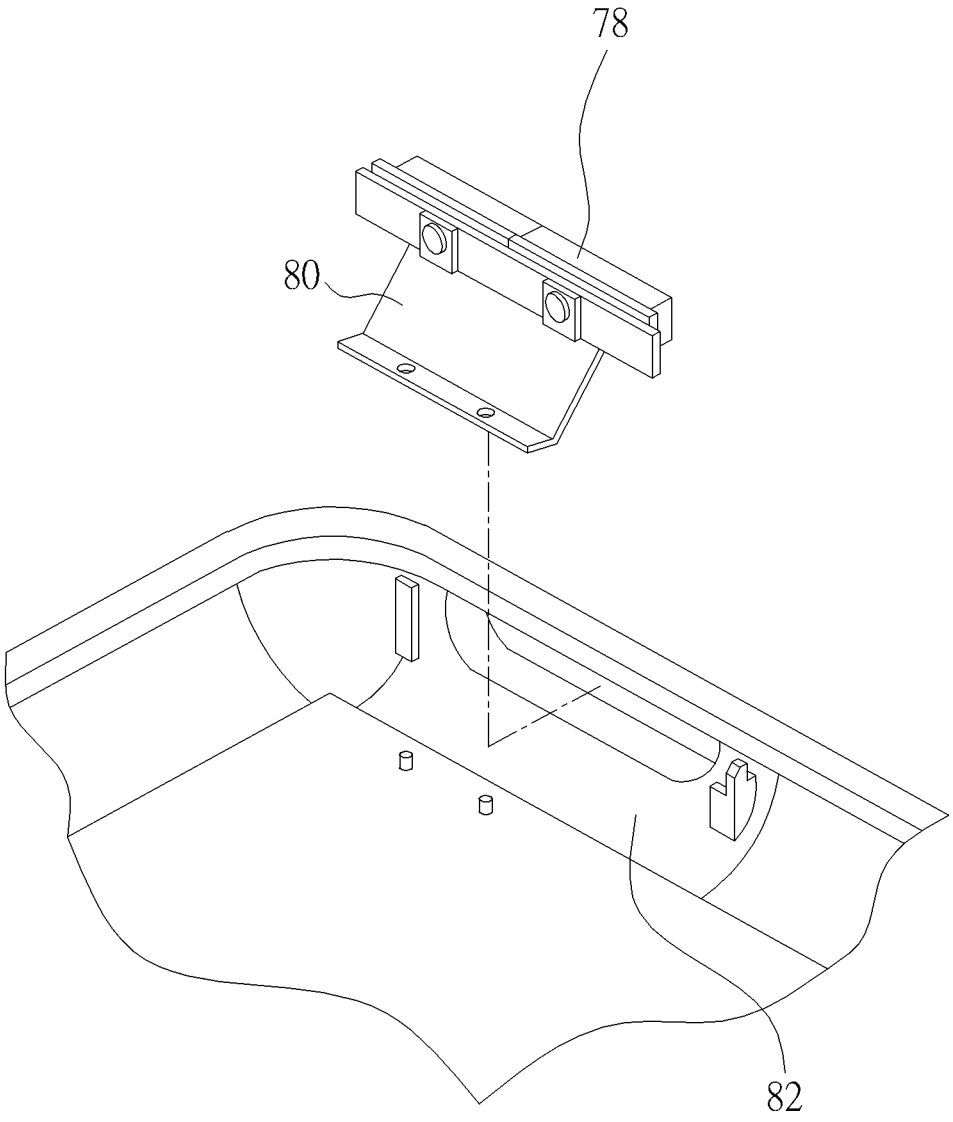
Figure 12:
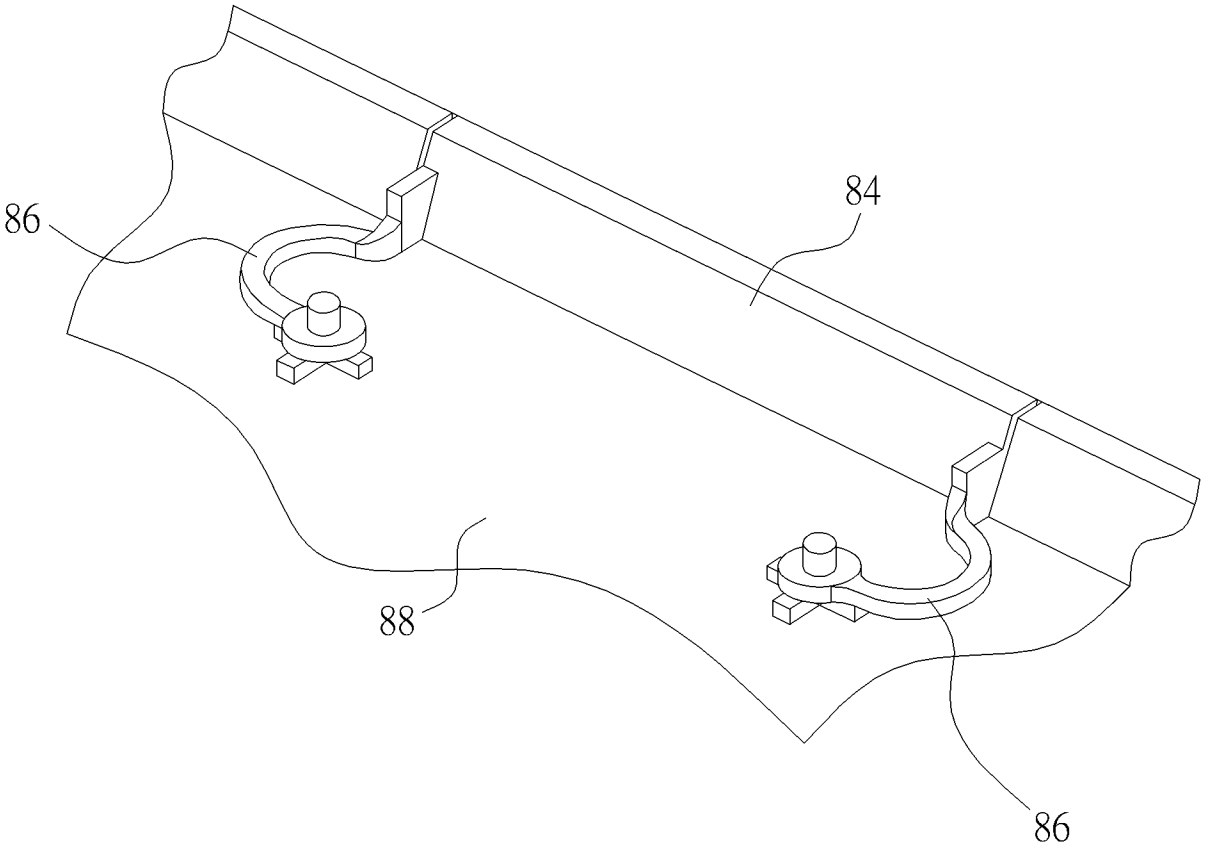

Please refer to FIG. 8 and FIG. 9. FIG. 8 is an assembly diagram of the detachable keyswitch mechanism 16 according to a third embodiment of the present disclosure. FIG. 9 is an exploded diagram of the detachable keyswitch mechanism 16 according to the third embodiment of the present disclosure. In the third embodiment, elements having the same numeral as ones of the above-mentioned embodiments have the same structures and functions. Difference between the third embodiment and the above-mentioned embodiments is: the recovering portion 44" of the keyswitch 28 is a curved resilient arm. An end (such as the first end 52) of the curved resilient arm is bent from the body 40. The curved resilient arm can increase resilient recovering force of the recovering portion 44", and further increase assembly strength of the recovering portion 44" and the body 40 accordingly to prevent accidental fracture by overload.

Element dimensions of the foresaid detachable keyswitch mechanism of the present disclosure are illustrated in detail. As shown in FIG. 2, an axle diameter d1 of the second rotating portion 42 (a width of an axle hole on the first rotating portion 36) may be preferably equal to or larger than 1 mm. A distance d2 between a level center of the switch 20 and an axle center of the second rotating portion 42 may be preferably equal to or larger than summation of 2 mm and a half of the axle diameter d1. Press route d3 of the pressing portion 66 protruding from the opening structure 34 may be preferably equal to or larger than 0.2 mm. An interval d4 formed between the actuating portion 46 and the switch 20 may be preferably equal to or larger than 0.2 mm. As shown in FIG. 3, a length d5 of the second rotating portion 42 protruding from the body 40 may be preferably equal to or larger than 1 mm. A length d6 of the recovering portion 44 may be preferably equal to or larger than 10 mm. A sectional width d7 of the recovering portion 44 may be preferably equal to or larger than 0.7 mm. A sectional height d8 of the recovering portion 44 may be preferably equal to or larger than 1.2 mm. Height variation d9 of the actuating portion 46 from the first position shown in FIG. 2 to the second position shown in FIG. 5, where the actuating portion 46 contacts the first unit 22 of the switch 20, may be preferably equal to 0.007 mm.

The keyswitch of the present disclosure is an integrated structure, which means the recovering portion and the second rotating portion are integrated with the body monolithically to decrease procedure and working hours of assembly of the keyswitch and the base. In addition, the base can include two first rotating portions and two constraining portions symmetrically disposed on the opposite sides of the opening structure, the keyswitch can include two second rotating portions and two recovering portions symmetrically disposed on the two corresponding positions of the body, and the keyswitch is easily assembled with the base. Element amounts of the base and the keyswitch are not limited to the foresaid embodiments, and depend on design's demand. For assembly of the detachable keyswitch mechanism, the second rotating portion of the keyswitch is put on the first rotating portion of the base, and the recovering portion is pressed to generate resilient deformation to buckle the recovering portion between the hook and the constraining portion. Therefore, the keyswitch can rotate relative to the base by the joint of the first rotating portion and the second rotating portion since the pressing portion of the keyswitch is pressed, and the actuating portion of the keyswitch can accurately actuate the switch on the circuit board.

For disassembly of the detachable keyswitch mechanism, the recovering portion is pressed to generate structural deformation to detach the recovering portion from the hook, and the keyswitch can be directly detached from the base accordingly without constraint. In conclusion, the present disclosure provides the detachable keyswitch mechanism with detachable function and the related electronic device. The keyswitch with integrated assembly of the body and the recovering portion can decrease the working hours and has no thermal melting cost. Further, the keyswitch is assembled with the base by the constraining portion and the rotating portion to increase assembly yield of product, and to prevent the detachable keyswitch mechanism from damage or disengage during transportation of the electronic device. Comparing to the prior art, the present disclosure provides the detachable keyswitch mechanism with rework function and the related electronic device that have advantages of high assembly yield, low manufacturing cost and easy assembly.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A detachable keyswitch mechanism, comprising:

a base having a bottom plate and a lateral plate, the lateral plate being bent from the bottom plate, the base comprising:

an opening structure disposed on the lateral plate;

at least one first rotating portion disposed between the bottom plate and the lateral plate;

a constraining portion disposed on the bottom plate; and a positioning portion disposed on the bottom plate and comprising a slide slot;

a keyswitch detachably assembled with the base, the keyswitch comprising:

a body rotatably disposed inside the opening structure, the body comprising a first side and a second side opposite to each other, the body being spaced from the positioning portion while the keyswitch is not pressed, and the body contacting the positioning portion to constrain a relative movement between the body and the opening structure while the keyswitch is pressed;

at least one second rotating portion disposed on the first side and pivoting to the first rotating portion;

at least one recovering portion comprising a first end and a second end opposite to each other, the first end being connected to the second side of the body, and the second end contacting against the constraining portion; and an actuating portion disposed on a surface of the body to actuate a switch disposed on the base, and the actuating portion moving inside the slide slot to constrain a movement of the body relative to the opening structure.

2. The detachable keyswitch mechanism of claim 1, wherein the first rotating portion is an arc structure, the second rotating portion is a pillar structure stretching from the body, and the pillar structure is rotatably disposed inside the arc structure.

3. The detachable keyswitch mechanism of claim 1, wherein the body is rotatably switched between a first position and a second position relative to the opening structure.

4. The detachable keyswitch mechanism of claim 3, wherein the keyswitch further comprises a pressing portion disposed on the other surface of the body opposite to the actuating portion, the pressing portion protrudes from the opening structure since the body is located on the first position, and the pressing portion is partially retracted into the opening structure since the body is located on the second position.

5. The detachable keyswitch mechanism of claim 4, wherein the switch comprises a first unit and a second unit, the first unit slides relative to the second unit to actuate the second unit, a slide direction of the first unit relative to the second unit is substantially parallel to a connective direction between the actuating portion and the pressing portion.

6. The detachable keyswitch mechanism of claim 3, wherein the recovering portion is resiliently deformed by inverse pressure of the body and the constraining portion since the body moves to the second position.

7. The detachable keyswitch mechanism of claim 1, wherein the base further comprises a hook disposed on the bottom plate and located between the opening structure and the constraining portion, a first part of the hook is connected to the bottom plate, a second part of the hook is bent from an end of the first part opposite to the bottom plate, and the second part contacts against a top of the recovering portion.

8. The detachable keyswitch mechanism of claim 7, wherein the first part and the constraining portion respectively contact against opposite lateral surfaces of the recovering portion.

9. The detachable keyswitch mechanism of claim 1, wherein the recovering portion is a straight resilient arm or a curved resilient arm, the first end of the recovering portion is bent from the body or disposed on a stretching portion of the body.

10. An electronic device, comprising:

a first casing;

a second casing assembled with the first casing; and a detachable keyswitch mechanism detachably disposed between the first casing and the second casing, the detachable keyswitch mechanism comprising:

a base disposed on the first casing, the base having a bottom plate and a lateral plate, the lateral plate being bent from the bottom plate, the base comprising:

an opening structure disposed on the lateral plate;

at least one first rotating portion disposed between the bottom plate and the lateral plate;

a constraining portion disposed on the bottom plate; and a positioning portion disposed on the bottom plate and comprising a slide slot;

a keyswitch detachably assembled with the base, the keyswitch comprising:

a body rotatably disposed inside the opening structure by connection of the second casing and the base, the body comprising a first side and a second side opposite to each other, the body being spaced from the positioning portion while the keyswitch is not pressed, and the body contacting the positioning portion to constrain a relative movement between the body and the opening structure while the keyswitch is pressed;

at least one second rotating portion disposed on the first side and pivoting to the first rotating portion;

at least one recovering portion comprising a first end and a second end opposite to each other, the first end being connected to the second side of the body, and the second end contacting against the constraining portion; and an actuating portion disposed on a surface of the body to actuate a switch disposed on the base, and the actuating portion moving inside the slide slot to constrain a movement of the body relative to the opening structure.

11. The electronic device of claim 10, wherein the first rotating portion is an arc structure, the second rotating portion is a pillar structure stretching from the body, and the pillar structure is rotatably disposed inside the arc structure.

12. The electronic device of claim 10, wherein the body is rotatably switched between a first position and a second position relative to the opening structure.

13. The electronic device of claim 12, wherein the keyswitch further comprises a pressing portion disposed on the other surface of the body opposite to the actuating portion, the pressing portion protrudes from the opening structure since the body is located on the first position, the pressing portion is partially retracted into the opening structure since the body is located on the second position, the switch comprises a first unit and a second unit, the first unit slides relative to the second unit to actuate the second unit, and a slide direction of the first unit relative to the second unit is substantially parallel to a connective direction between the actuating portion and the pressing portion.

14. The electronic device of claim 12, wherein the recovering portion is resiliently deformed by inverse pressure of the body and the constraining portion since the body moves to the second position.

15. The electronic device of claim 10, wherein the base further comprises a hook disposed on the bottom plate and located between the opening structure and the constraining portion, a first part of the hook is connected to the bottom plate, a second part of the hook is bent from an end of the first part opposite to the bottom plate, the second part contacts against a top of the recovering portion, and the first part and the constraining portion respectively contact against opposite lateral surfaces of the recovering portion.

16. The electronic device of claim 10, wherein the recovering portion is a straight resilient arm or a curved resilient arm, the first end of the recovering portion is bent from the body or disposed on a stretching portion of the body.

* * * * *